US010058872B2

(12) United States Patent
Borges et al.

(10) Patent No.: US 10,058,872 B2
(45) Date of Patent: Aug. 28, 2018

(54) VERTICAL BALL MILL WITH INTERNAL MATERIALS FLOW CONDUIT

(71) Applicant: STT ENVIRO CORP., Milton (CA)

(72) Inventors: Tyler Borges, Richmond (CA); Xiaoqi "Stephen" Fang, Richmond (CA); Chien-Ee Ng, Richmond (CA); Calin Sarban, Richmond (CA)

(73) Assignee: STT Enviro Corp. (CA)

( * ) Notice: Subject to any disclaimer, the term of this patent is extended or adjusted under 35 U.S.C. 154(b) by 1022 days.

(21) Appl. No.: 14/323,149

(22) Filed: Jul. 3, 2014

(65) Prior Publication Data

US 2016/0001295 A1 Jan. 7, 2016

(51) Int. Cl.
*B02C 17/16* (2006.01)
*B02C 17/00* (2006.01)

(52) U.S. Cl.
CPC ..... *B02C 17/163* (2013.01); *B02C 17/00* (2013.01); *B02C 17/16* (2013.01)

(58) Field of Classification Search
CPC ..... B02C 17/00; B02C 17/16; B02C 17/163
USPC ..... 241/170–172
See application file for complete search history.

(56) References Cited

U.S. PATENT DOCUMENTS 4,242,002 A * 12/1980 Kawabata ..... B01F 7/00025 241/172
4,754,934 A * 7/1988 Ikebuchi ..... B02C 17/16 241/171
5,158,240 A * 10/1992 Ihara ..... B01F 3/04539 241/172
5,188,808 A * 2/1993 Lilja ..... B01D 19/0052 366/307
5,346,146 A * 9/1994 Nitta ..... B02C 17/16 241/172
5,630,558 A * 5/1997 Nitta ..... B02C 17/16 241/172
5,779,165 A * 7/1998 Kim ..... E03C 1/2665 241/33
6,786,631 B2 * 9/2004 Lipp ..... B01F 7/00158 366/322
7,971,808 B2 * 7/2011 Gerl ..... B02C 17/16 241/172
8,505,842 B2 * 8/2013 Fornasier ..... B01F 7/00208 241/131

* cited by examiner

*Primary Examiner* — Faye Francis
(74) *Attorney, Agent, or Firm* — Cohen & Grigsby, PC

(57) ABSTRACT

A vertical ball mill for grinding a solid input material to form a slurry, and includes a grinding tank which defines a mixing chamber, rotatable main auger assembly having mixing blade in a lower portion of the mixing chamber and a materials flow guide. The flow conduit is provided within the grinding tank interior, and includes one or more conduit segments configured to direct input material downwardly in the grinding tank towards the lower mixing chamber and auger mixing blade. An impeller is provided within the flow conduit, with a blade configuration selected to effect the downward flow of input material through the conduit segments and outwardly therefrom adjacent to the mixing blade as the auger assembly is rotated.

20 Claims, 5 Drawing Sheets

VERTICAL BALL MILL WITH INTERNAL MATERIALS FLOW CONDUIT

SCOPE OF THE INVENTION

The present invention relates to vertical grinding mills, and more particularly vertical ball mills which incorporate an internal flow baffle, guide or conduit for directing the flow of input materials towards a lower region of the mill grinding/mixing chamber.

BACKGROUND OF THE INVENTION

Vertical grinding mills are widely used in industrial process applications in the reduction and/or pulverization of ore, rock, minerals and other input materials for subsequent processing in mining applications, as well as for example, in the manufacture of fertilizers, cement, glass and ceramics. Conventionally, vertical grinding mills are provided with a grinding tank which is adapted to receive both a volume of solution and the material to be ground or pulverized as either part of a batch or continuous process. An impeller assembly is provided with a mixing or grinding blade which is positioned in a lower region of the grinding tank. When rotated, the mixing blade effects the mixing and physical abrasion of the solution and input material to form a slurry in which fine reduced particles of the infed material is contained in suspension, and which then flows or is pumped from the grinding tank for further processing.

To better effect pulverization, it is furthermore known to introduce into the bottom of the grinding tank, a quantity of hardened metal balls. When introduced, the cascading movement of such balls, combined with the rotary agitation of the mixing blade, achieves more effective and uniform material pulverization and grinding.

The applicant has appreciated that conventional vertical grinding mills, and in particular ball mills, continue to suffer the disadvantage that the input material may reside within lower regions of the grinding tank for insufficient time to achieve the desired materials size reduction/pulverization. In particular, where slurries are formed having higher input materials to grinding solution ratios, coarser ground materials of a pebble size or greater may tend to flow with the slurry outwardly from the grinding tank prematurely. The inclusion of coarser materials in the output slurry has the potential to adversely affect subsequent manufacturing steps. This may be of greatest importance where the relative amount of ground material to solution is more critical for the production of final products, as for example, where vertical mills are used as part of a lime slaking process in the production of slaked lime for pollution control applications.

SUMMARY OF THE INVENTION

The present invention relates to a vertical grinding mill, and most preferably a vertical ball mill for use in reducing grinding and/or pulverizing a solid input material to form a mixture or slurry. Preferred materials to be input include rock, mineral and ores which, depending on the overall grinding mill size, are supplied to the mill in pebble form ranging in diameter from several millimeters to 10 cm or more. It is to be appreciated however, that the present invention may be used in the grinding of a variety of different materials, including without restriction food stuffs, polymers and resins, and other goods in manufacture. Most preferably, the present invention is provided as a vertical slaking mill used in lime slaking production and includes a grinding tank which defines at its lower region a mixing chamber for mixing calcium oxide and water to form a lime slurry.

The grinding mill includes a rotatable main impeller or auger assembly which is provided with a grinding or mixing blade which is disposed in a lower portion of the mixing chamber for effecting both the agitation and grinding of the input pebble material and its mixture with the slurry solution. The mixing blade may be provided in the form of radially projecting arms or paddles, but more preferably is provided as a helically extending vane.

Although not essential, the auger assembly may further include a scraper blade which is positioned for rotation about the side of the grinding tank to dislodge and prevent the static accumulation of produced slurry along the grinding tank sidewall.

A materials flow guide or internal conduit is provided within the grinding tank interior. The flow guide includes one or more conduit segments configured to direct the flow of input pebble material downwardly into the grinding tank towards the lower mixing chamber and auger mixing blade. Most preferably, the flow conduit includes at least one, and preferable at least two generally cylindrical conduit segments which are coaxially aligned with a vertically oriented auger assembly shaft. An upper portion of the flow conduit is provided in communication with a materials feed port through which the input material is fed into the grinding tank for reduction and/or pulverization, and opens at its lower end into the mixing chamber adjacent to the mixing blade. A screw, impeller, auger or vane or other agitator assembly (hereinafter collectively an impeller) is provided having a blade configuration selected to effect a positive downward flow of input material through the conduit segments and outwardly therefrom adjacent to the mixing blade as the auger assembly is rotated.

Preferably the screw or impeller is mounted within a conduit segment in a position secured to the auger assembly shaft for rotation therewith. More preferably, the impeller is provided with a blade pitch angle which is inclined in the opposite direction to the pitch angle of the auger mixing blade. In this manner input materials fed into the grinding tank are drawn or moved by the impeller downwardly towards the bottom of the mixing chamber, ensuring their more complete pulverization by the mixing blade and/or mill balls.

Optionally, one or more of the conduit segments may be provided with internal baffles to assist in maintaining a more laminar flow of input materials along and/or outwardly from the flow guide.

Although not essential, in one preferred embodiment, the flow guide and impeller assembly are provided as part of a kit for retrofitting existing vertical grinding mills. In one such construction, the conduit segments and/or the mixing assembly are formed having a mechanically connectable multicomponent design.

Accordingly, the present invention resides in at least the following non-limiting aspects.

A vertical ball mill for forming a mineral slurry comprising, a grinding tank having a top feed port and generally cylindrical sidewall defining a side of a mixing chamber for receiving minerals to be milled therein, a selectively rotatable auger assembly having a vertically elongated axially extending shaft and at least one mixing blade provided at a lower portion of said shaft and disposed in a said mixing chamber, and at least one scraper blade disposed above said mixing blade, said scraper blade being coupled to said shaft by a support arm extending radially from said shaft towards said sidewall, a flow guide assembly disposed in said grinding tank for guiding said minerals from said top feed port towards said mixing blade, the flow guide assembly including, a first upper conduit portion and a second lower conduit portion, the upper and lower conduit portions each being spaced from and extending radially about said shaft at positions spaced respectively above and below said scraper support arm, and defining a gap therebetween, the top feed port being configured to convey said minerals to be milled into said upper conduit, an impeller assembly coupled to said shaft at a position generally spaced below said scraper arm for rotation therewith, said impeller assembly including at least one agitator blade having a pitch orientation selected whereby the rotation of said at least one agitator blade with said shaft effects the downward movement of said minerals from said first conduit portion and through said second conduit portion towards said mixing blade.

A vertical grinding mill comprising, a mill enclosure having a sidewall defining a mixing chamber for receiving materials to be milled therein, an auger assembly mounted for selective rotational movement relative to said missing chamber, the auger assembly including an axially elongated rotatable shaft, at least one mixing blade secured towards a lower portion of said shaft and disposed in a said mixing chamber, and at least one scraper spaced above said mixing blade, said scraper including a radially extending support arm extending from said shaft towards said sidewall, a flow guide assembly for guiding said materials towards said lower portion of said mixing chamber, the flow guide assembly including, a first conduit portion and a second conduit portion, the first and second conduit portions each being spaced from and extending radially about said shaft at positions spaced respectively above and below said scraper support arm, and defining a gap therebetween, a materials feed-pipe for conveying said materials to be milled into an upper portion of said first conduit portion, an impeller assembly coupled to said shaft at a position spaced below said scraper support arm for rotation therewith, said impeller assembly including at least one agitator blade having a pitch orientation selected whereby the rotation of said shaft and at least one agitator blade effects the downward flow of said materials from said first conduit portion and through said second conduit portion towards said mixing blade.

A material flow guide assembly kit for retrofitting a vertical ball mill comprising, a grinding tank having a top and generally cylindrical sidewall having a radial dimension and defining a side of a mixing chamber for receiving materials to be milled therein, and a rotatable auger assembly having a vertically elongated axially extending shaft, a mixing blade provided at a lower portion of said shaft and disposed in a said mixing chamber, and at least one scraper blade disposed above said mixing blade, said scraper blade being coupled to said shaft by a radially extending support arm, and the flow guide assembly kit including, a first conduit section having two mechanically connectable generally semi-circular halves, the semi-circular halves being connectable to form a first cylindrical conduit segment having a radially dimension selected at between about 25% to about 75%, and preferably about 40% to 60% of the radial dimension of the sidewall, and at least one coupling member for securing the first conduit segment to at least one of the grinding tank top or cylindrical sidewall in a position above said support arm and coaxially aligned with said shaft, a second conduit section having two mechanically connectable generally semi-circular halves, the semi-circular halves being connectable to form a second cylindrical conduit segment having a radial dimension selected at between about 25% to about 75%, and preferably about 40% to 60%, of the radial dimension of the sidewall, and wherein at least one of the semi-circular halves includes, at least one radially orientated baffle member, and at least one mounting arm for securing the second conduit segment to the grinding tank sidewall in a position generally interposed between said support arm and said mixing blade and coaxially aligned with said shaft, and an impeller assembly connectable to said shaft at an operating position generally spaced below said scraper arm for rotation therewith, said impeller assembly including a clamping member for mechanically coupling the impeller assembly to the shaft for rotation therewith, and at least one agitator blade having a pitch orientation selected whereby the rotation of said at least one agitator blade with said shaft effects the downward movement of said materials from said first conduit segment and through said second conduit segment towards said mixing blade.

BRIEF DESCRIPTION OF THE DRAWINGS

Reference may now be had to the following detailed description take together with the accompanying drawings in which.

DETAILED DESCRIPTION OF THE PREFERRED EMBODIMENTS

Figure 1:
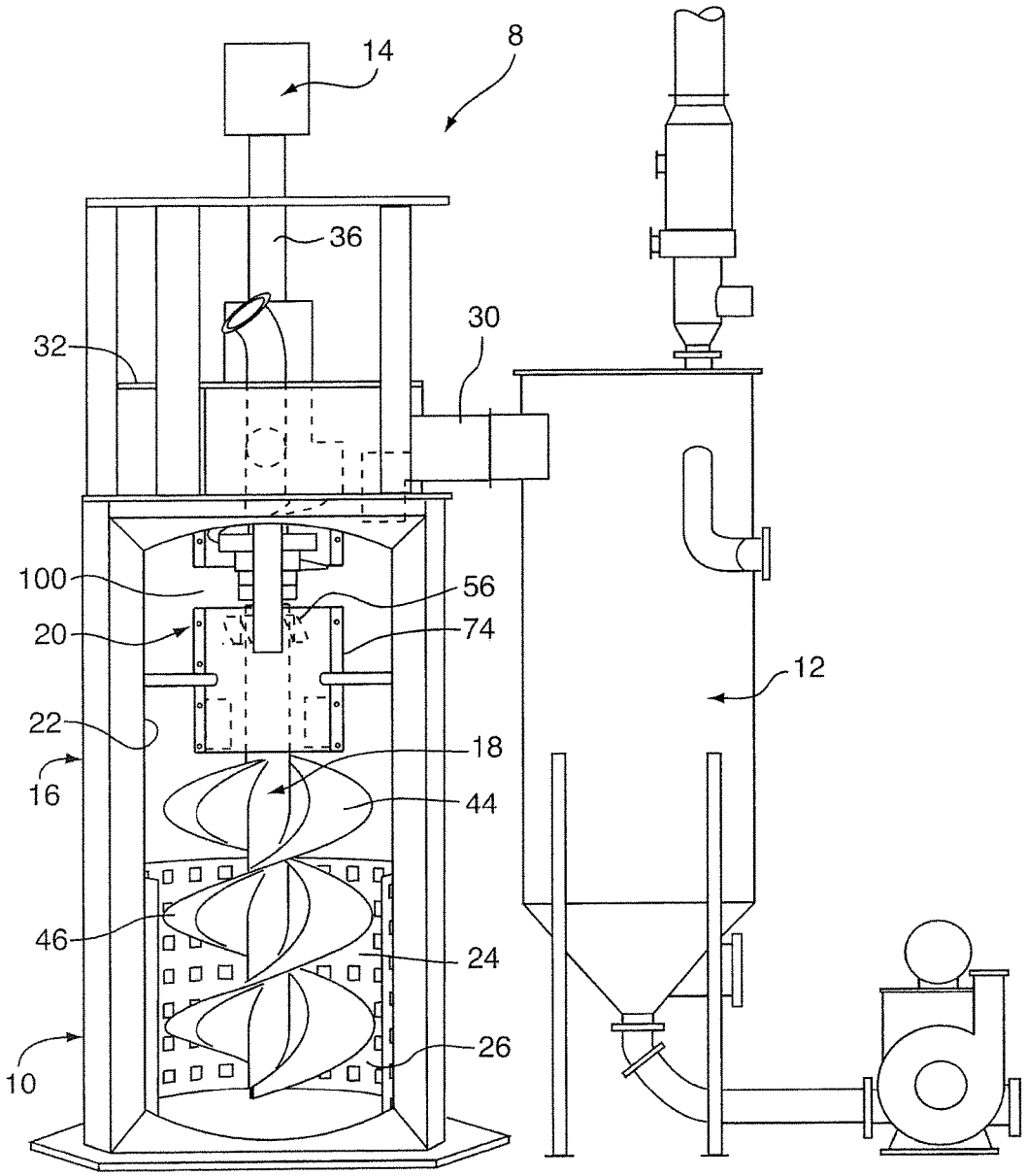
FIG. 1 illustrates schematically a lime slaking apparatus in accordance with a preferred embodiment of the invention.

Reference may be had to FIG. 1 which illustrates a lime slaking apparatus 8 used in the production of slaked lime in accordance with a preferred embodiment. The slaking apparatus 8 includes a vertical ball mill 10 and separator 12. As will be described, the vertical ball mill 10 is used in conjunction with a number of hardened stainless steel grinding balls 11 in the grinding and mixture of calcium oxide as an input mineral with water to produce a slaked lime slurry. Most preferably, calcium oxide is initially fed into the ball mill 10 having an average particle diameter of from several millimeters to less than 10 cm, and preferably in pebble form with a diameter less than 6.4 cm. The ball mill 10 in turn, is fluidically coupled to the separator 12 and which is used to reduce the water content in the produced slurry to the desired final water to lime ratio.

Figure 2:
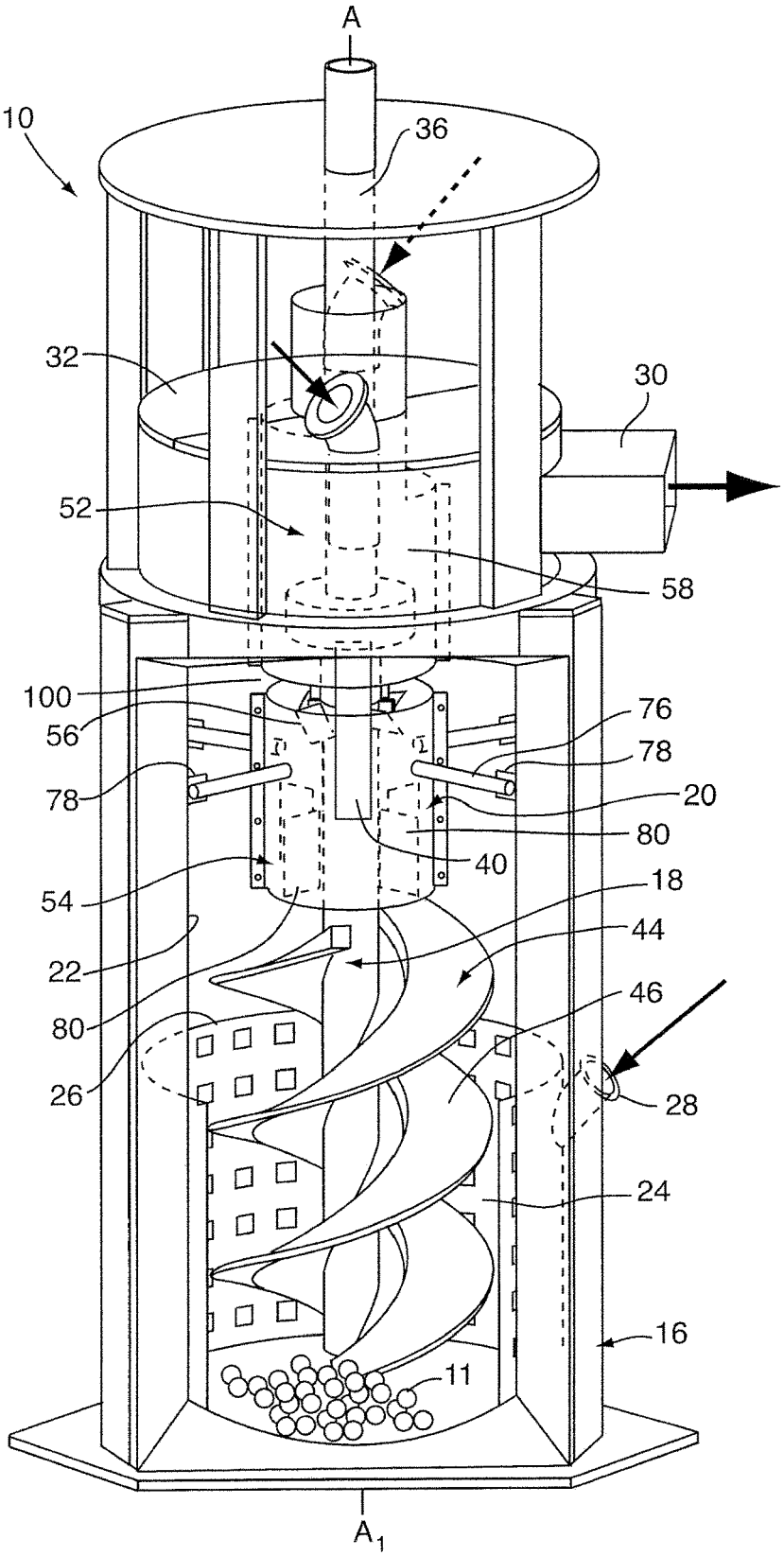
FIG. 2 shows a partially cutaway perspective view of a vertical ball grinding mill used in the lime slaking apparatus of FIG. 1.
Figure 3:
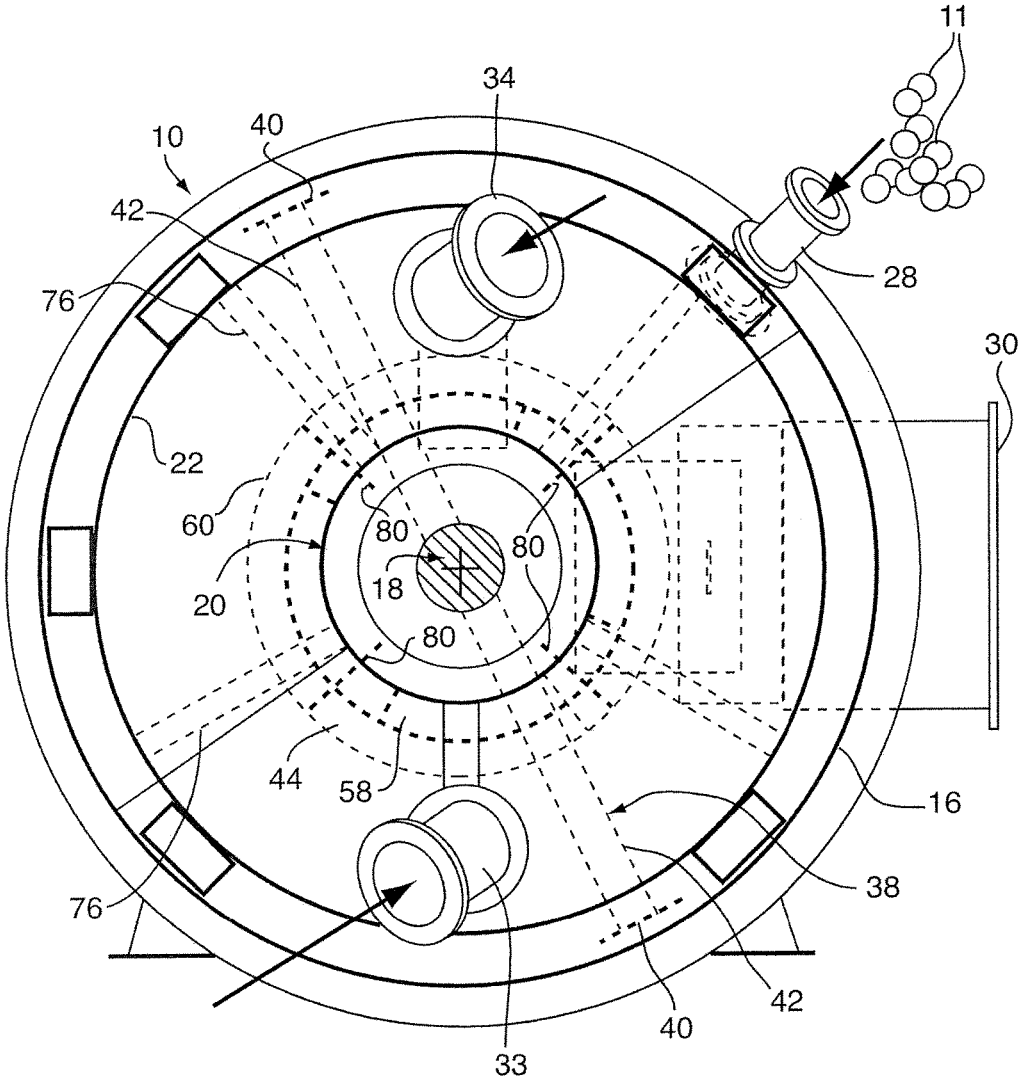
FIG. 3 shows a top view the vertical grinding mill shown in FIG. 2.

FIGS. 2 and 3 show best the vertical ball mill 10 used in the lime slaking apparatus 8 of FIG. 1. The ball mill 10 includes a vertically elongated cylindrical grinding tank 16, an axially elongated auger assembly 18, an internally disposed materials flow guide assembly 20, and a drive motor 14 (FIG. 1) which, as will be described, is selectively operable to effect the rotation of the auger assembly 18 relative to the grinding tank 16 to effect slurry formation, materials grinding and mixing.

The grinding tank 16 includes a generally cylindrical steel sidewall 22 which extends vertically, and which defines at its lower extent the slurry mixing chamber 24. Optionally, a cylindrical metal shielding layer 26 may be provided with the tank interior about the mixing chamber 24. The shielding layer 26 shields the sidewall 22 from the impact of the grinding balls 11, to prolong the operating life the mill 10. A lower ball port 28 is formed through the sidewall 22 and shielding layer 26. The ball port 28 is configured to allow the introduction and/or replacement of stainless steel grinding balls 11 into the lower portion of the mixing chamber 24 to facilitate the grinding and pulverization of the calcium oxide (CaO) pebbles.

FIG. 1 shows best a slurry outfeed port 30 as being formed through the sidewall 22 adjacent to an upper edge of the grinding tank sidewall 22. As shown best in FIG. 1, the outfeed port 30 provides fluid communication with an upper region of the separator 12, allowing slurry produced in the ball mill 10 to rise in the grinding tank 16 and flow therethrough into the separator 12 as part of a continuous manufacturing process.

FIG. 2 shows the upper end of the grinding tank 16 as being closed by a removable sealing cover 32. In a most preferred construction, the sealing cover 32 is provided with a split or two-part construction, and is adapted to be mechanically secured in place over the upper edge of the sidewall 22 by clamps or other mechanically fasteners (not shown). FIG. 3 shows best a fluid inlet port 33 and materials infeed port 34 as each extending through the sealing cover 32. The fluid inlet port 33 and materials infeed port 34 are configured to respectively permit the introduction of water and pebble calcium oxide as the solid infeed material into the grinding tank 16 in a substantially continuous flow manner, to effect slurry production in the mixing chamber 24.

The auger assembly 18 is shown best in FIG. 2 as including an elongated auger shaft 36 which is provided in a coaxially aligned orientation with the axis A-$A_1$ of cylindrical sidewall 22. The auger shaft 36 is mounted for rotary movement relative to the grinding tank 16. The shaft 36 extends vertically from a lower end positioned in the slurry mixing chamber 24, through the top sealing cover 32 to an upper end portion which is selectively journaled in rotation by the drive motor 14. A scraper blade assembly 38 is secured to the auger shaft 36 in a position spaced towards an upper end of the slurry mixing chamber 24. The scraper blade assembly 38 as shown best in FIG. 3, includes a pair of vertically oriented metal scraper blades 40 which are mounted on the end of a radially extending support arm 42 so as to be moveable with the auger shaft 36 about the cylindrical sidewall 22 immediately beneath the slurry outfeed port 30.

FIG. 2 further shows the auger assembly 18 as including a mixing blade 44 coupled to a lower most portion of the auger shaft 36. The mixing blade 44 extends vertically into a lower region of the slurry mixing chamber 24. In a most preferred construction, the mixing blade 44 is provided with a downwardly spirally helical vanes 46. The vanes 46 are formed from steel, and have a vane angle which is selected to effect fluid and grinding ball 11 displacement uplift as the shaft 36 is rotated. The uplift draw and admixing of grinding balls 11 and the input mineral pebbles thus effects mechanical impact, mixing and pulverization of the input material as the auger shaft 36 is turned.

The materials flow guide assembly 20 is provided within the interior of the grinding tank 16 to facilitate the initial movement of the mineral pebbles as they are initially fed into the grinding mill 10, and move from the materials infeed port 34, towards the mixing blade 44. The guide assembly 20 is provided to restrict the premature movement of unground or only partially ground pebble minerals flowing with the slurry from the grinding tank 16 outwardly through the slurry outfeed port 30. In particular, the materials flow guide assembly 20 includes upper and lower conduit portions, 52, 54 and an impeller assembly 56. As will be described with reference to FIG. 6, the impeller assembly 56 is provided with one or more angled metal vanes 58 which have an angle orientation selected to effect the downward flow of pebble materials towards the lower region of the mixing chamber 24, and which preferably have a vane angle which is inclined in the opposite direction to that of the vanes 46.

Figure 4:
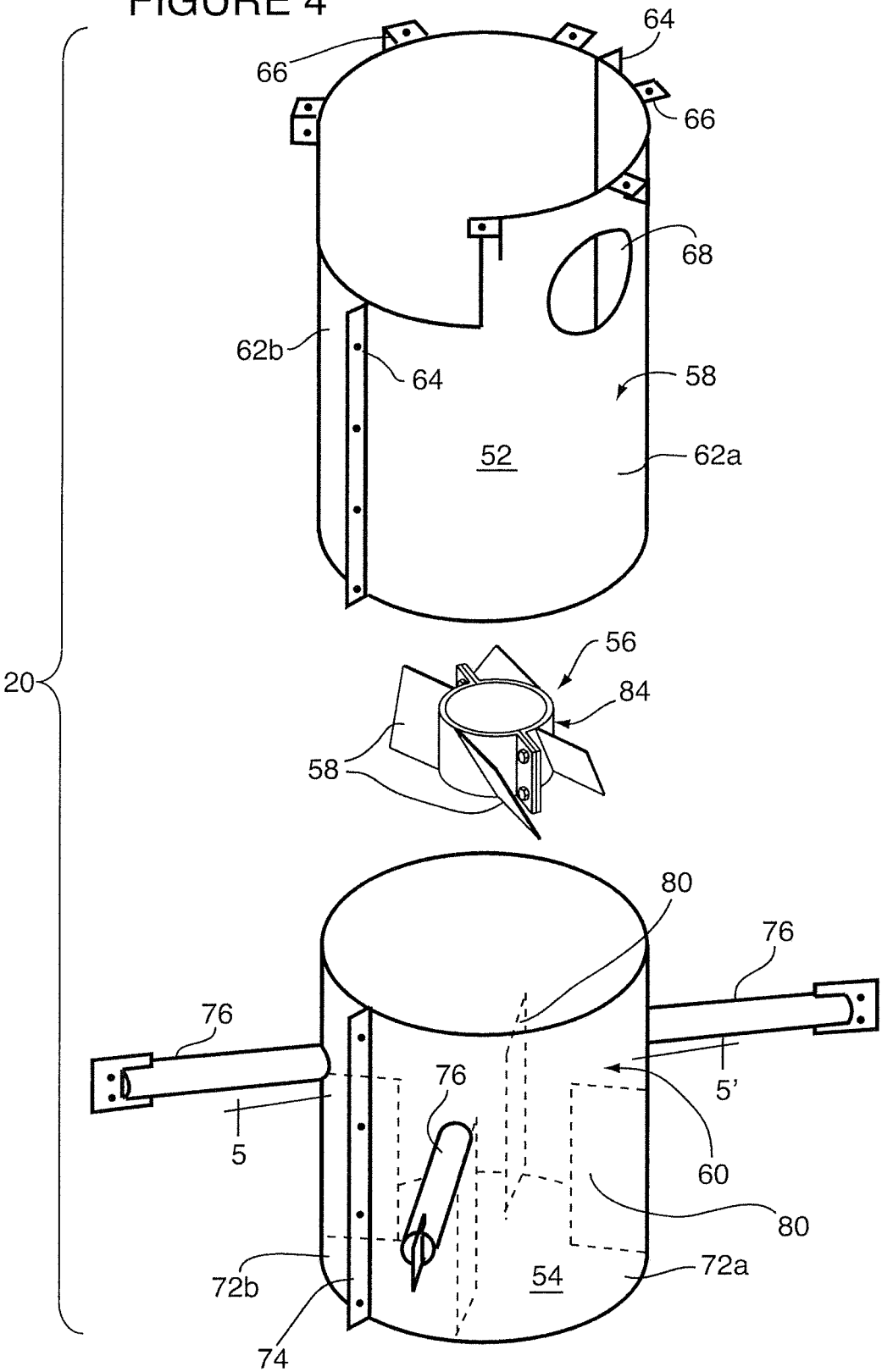
FIG. 4 shows a perspective view of the conduit segments used in the materials flow guide of the vertical grinding mill of FIG. 2.

FIG. 4 shows best the upper and lower conduit portions 52, 54 as each including respectively, a solid cylindrical metal wall 58, 60. Although not essential, most preferably each wall 58, 60 has the same radial diameter, and which is selected between about 25 to 75%, and most preferably 40 to 60% of the radial diameter of the cylindrical sidewall 22. The wall 58 is preferably provided with a two-part construction, consisting of generally semi-cylindrical halves 62*a*, 62*b*. Each wall half 62*a*, 62*b* is provided with side coupling flanges 64 which are adapted for mated juxtaposition and to receive mechanical fasteners (not shown) allowing the upper conduit portion 52 to be assembled in place about the auger shaft 36 of an existing vertical ball mill 10. Although not essential, the sidewall halves 62*a*, 62*b* further are preferably provided with one or more upper mounting flanges 66 along their upper edges. The mounting flanges 66 may be selected for either weldment or mechanical engagement with the underside of the sealing cover 32, allowing the conduit portion 52 to be suspended therefrom within the interior of the grinding tank 16. FIG. 2 shows the upper conduit portion 52 as having an axial length selected so that when secured to the sealing cover 32, the upper conduit portion 52 is oriented with the cylindrical wall 58 concentrically positioned about the auger shaft 36 and axis A-$A_1$. Most preferably, when positioned, the conduit portion 52 is spaced marginally a distance above the scraper blade support arms 42, so as not to interfere with rotation of the scraper blades 40.

In the embodiment shown, the upper conduit portion 52 is shown with a circular cut-out 68 which is sized to receive the materials infeed port 34 therethrough. In this manner, pebble mineral which is fed into the grinding tank 16 flows into the upper end of materials flow guide assembly 20. It is to be appreciated, however, that depending on the overall diameter of the vertical ball mill sidewall 22, the materials infeed port 34 could alternately extend through the sealing cover 32 directly into the interior of the upper conduit portion 52.

Figure 5:
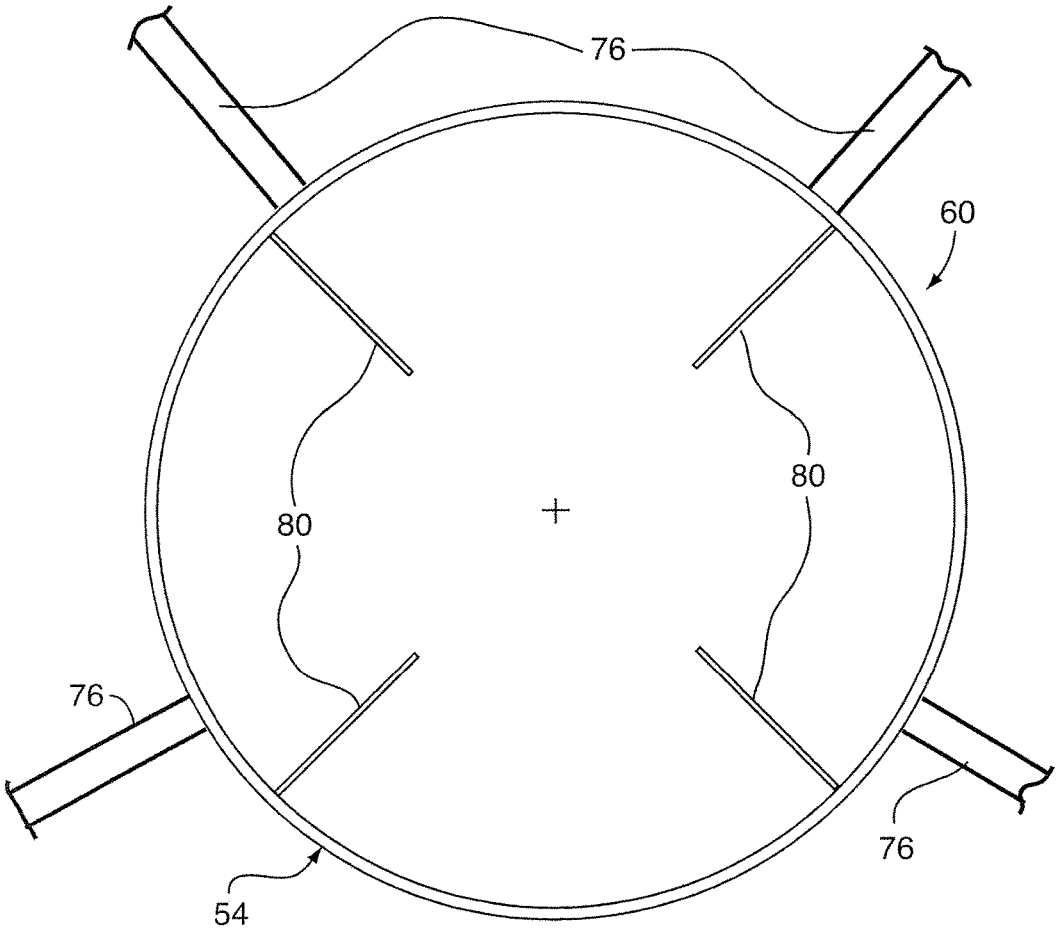
FIG. 5 shows a cross-sectional view of the lower conduit segment shown in FIG. 4 taken along line 5-5[1]

FIGS. 2 and 5 show best the lower conduit portion 54 as having a metal sidewall which is formed as a two-part construction, and which includes two semi-cylindrical halves 72*a*, 72*b*. Each of the halves 72*a*, 72*b* includes side coupling flanges 74 which are likewise adapted for mated juxtaposition and to receive mechanical connectors such as bolts (not shown) for connection to each other. As well a pair of radially projecting mounting arms 76 extend radially from each wall half 72*a*, 72*b*. The mounting arms 76 have a length selected to engage a complementary bracket or clip 78 (FIG. 2) secured to an internal surface of the cylindrical sidewall 22, whilst positioning the lower conduit position 54 in a coaxially aligned orientation with the upper portion 52.

FIG. 2 shows the lower conduit portion 54 as having an axial length selected such that when secured in place by the engagement of the mounting arms 76 with the clips 78, the conduit portion wall 60 is spaced a marginal distance below the scraper blade support arm 42, and above the mixing blade 44, defining a gap 100 between the conduit portions 52, 54 and so as not to interfere with either the scraper blade 40 or mixing blade 44 movement.

As shown best in FIG. 5, four vertically extending baffle plates 80 extend radially inwardly from the inner sides of the wall 60. Most preferably, the baffle plates 80 are formed as axially extending planar plates which are spaced towards a lowermost end of the wall 60, and project radially inwards a distance selected to locate a marginal distance from the auger shaft 36 in an orientation interposed between the impeller assembly 56 and mixing blade 44. The baffle plates 80 are configured to maintain a laminar flow of pebble mineral as it is fed into the grinding tank 16 and moves downwardly through and from the flow guide assembly 20.

Figure 6:
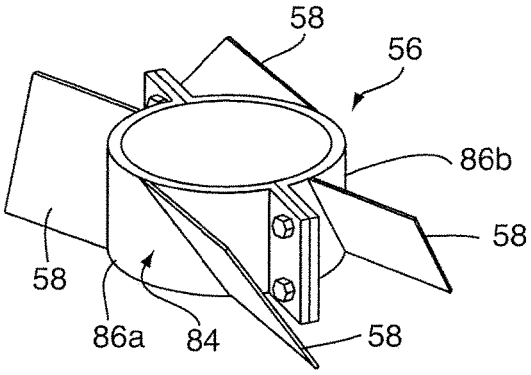
FIG. 6 shows a perspective view of an impeller assembly used in the vertical ball grinding mill of FIG. 2.

FIG. 6 shows best the impeller assembly 56 as including a two-piece clamping ring 84 which is divided into two halves 86*a*, 86*b* each having a pair of helically extending impeller blades or vanes 58 mounted thereto. The clamping ring 84 is selected to allow for the mechanical coupling of the impeller assembly halves 86*a*, 86*b* onto the auger shaft 36 adjacent to an upper end of the cylindrical wall 60. Although not essential, most preferably the vanes 58 are provided as a pitch blade turbine impeller.

Most preferably, the vanes 58 extend generally in a spiral direction opposite to the direction of helical winding of the mixing blade 44. In this manner, the rotation of the impeller assembly 56 with the auger shaft 36 effects a downward flow of input pebbles through the flow guide assembly 20 and to the mixing blade 44. More preferably, the vanes 58 are provided with a size and pitch selected to effect a slightly negative pressure in the lower conduit portion 54 which effects the drawing and partial recirculation of slurry from edge regions of the grinding tank 16 through the gap 100 between the upper and lower conduit portions 52, 54, whilst minimizing the movement of pebble mineral outwardly therethrough.

In this manner, with the present invention, water and input pebble minerals may be continuously fed through the fluid inlet port 33 and materials infeed port 34, respectively. Concurrently, the drive motor 14 is activated to rotate the auger shaft 36. As the auger shaft 36 is rotated, the pairs of impeller blades 58 draw the input pebble material downwardly through the flow guide assembly 20 and outwardly therefrom into the lower region of the mixing chamber 24 for mixing and pulverization by the grinding balls 11 and mixing blade 44. As the input minerals are pulverized and mixed, the formed slurry flows upwardly about the sides of the conduit portions 54, 52 along a periphery adjacent the edge regions of the cylindrical sidewall 22, moving outwardly from the grinding tank 16 via the slurry outfeed port 30 and into the separator 12 for further processing.

In a most preferred construction, the flow guide assembly 20 is provided in a kit form for use in retrofitting existing vertical ball mills. While the preferred embodiment resides in a kit for retrofitting existing grinding mills, it is to be appreciated, that in an alternate construction, the conduit portions 52, 54 and/or impeller assembly 56 could be provided as part of the ball mill 10 as original equipment manufacturer (OEM) equipment.

While the detailed description describes the present invention as used in lime slaking, the invention is not so limited. It is to be appreciated that the apparatus which is described may be used in both conventional vertical grinding mills as well vertical ball mill applications, in the grinding and processing of a variety of different types of materials.

Although the detailed description describes and illustrates various preferred embodiments, the invention is not so limited. Many modifications and variations will now occur to persons skilled in the art. For a definition of the invention, reference may be had to the appended claims.

We claim:

1. A vertical ball mill for forming a mineral slurry comprising, a grinding tank having a top feed port and cylindrical sidewall defining a side of a mixing chamber for receiving minerals to be milled therein, a selectively rotatable auger assembly having a vertically elongated axially extending shaft and at least one mixing blade provided at a lower portion of said shaft and disposed in a said mixing chamber, and at least one scraper blade disposed above said mixing blade, said scraper blade being coupled to said shaft by a support arm extending radially from said shaft towards said sidewall, a flow guide assembly disposed in said grinding tank for guiding said minerals from said top feed port towards said mixing blade, the flow guide assembly including, a first upper conduit portion and a second lower conduit portion, the upper and lower conduit portions each being spaced from and extending radially about said shaft at positions spaced respectively above and below said scraper support arm, and defining a gap therebetween, the top feed port being configured to convey said minerals to be milled into said upper conduit, an impeller assembly coupled to said shaft at a position spaced below said scraper arm for rotation therewith, said impeller assembly including at least one agitator blade having a pitch orientation selected whereby the rotation of said at least one agitator blade with said shaft effects the downward movement of said minerals from said first conduit portion and through said second conduit portion towards said mixing blade.

2. The mill as claimed in claim 1, wherein said first and second conduit portions each comprise an axially extending cylindrical wall coaxially aligned with said shaft, the cylindrical wall of each conduit portion having a radial diameter selected at between about 15 to 70%, and preferably about 40 to 60% of a radial diameter of the grinding tank cylindrical sidewall, so as to define a ground slurry flow path therebetween.

3. The mill as claimed in claim 1, wherein the second conduit portion further comprises, a plurality of baffle members extending from said cylindrical wall radially inwardly to a respective inner edge spaced a distance from said shaft.

4. The mill as claimed in claim 2, wherein said first and second conduit portion cylindrical walls have substantially the same diameter, each of the shaft, the grinding tank, cylindrical sidewall, and said conduit portion cylindrical walls being substantially coaxially aligned.

5. The mill as claimed in claim 2, wherein the second conduit portion includes a plurality of mounting arms extending radially outwardly from said second conduit portion cylindrical wall, and fixedly coupling said second conduit portion to said grinding tank cylindrical sidewall.

6. The mill as claimed in claim 1, wherein the impeller assembly comprises a pitch blade turbine impeller.

7. The grinding mill as claimed in claim 1, wherein each of the impeller assembly and the mixing blade comprise at least one helically or angularly extending fixed blade, the helically or angularly extending fixed blade of the impeller assembly extending in an inclined direction opposite to the helically or angularly extending fixed blade of the mixing blade.

8. The mill as claimed in claim 3, wherein the agitator blade comprises a two-part bolt-on blade configured for mechanical attachment to said shaft, wherein the cylindrical wall of each of said first and second conduit portion is provided as a two-part metal sleeve construction having two mechanically connectable semi-cylindrical halves.

9. The mill as claimed in claim 2, wherein the second conduit portion is mounted in said mixing chamber substantially adjacent to said mixing blade, and said grinding tank further includes, a grinding ball port spaced vertically below said flow guide assembly and for introducing grinding balls into the lower portion of said mixing chamber, and a slurry out-feed port spaced vertically above said gap and in fluid communication with said ground slurry flow path.

10. The mill as claimed in claim 9, wherein the ball mill comprises a vertical line slaking mill, and, said minerals to be milled comprise limestone.

11. A vertical grinding mill comprising, a mill enclosure having a sidewall defining a mixing chamber for receiving materials to be milled therein, an auger assembly mounted for selective rotational movement relative to said mixing chamber, the auger assembly including an axially elongated rotatable shaft, at least one mixing blade secured towards a lower portion of said shaft and disposed in a said mixing chamber, and at least one scraper spaced above said mixing blade, said scraper including a radially extending support arm extending from said shaft towards said sidewall, a flow guide assembly for guiding said materials towards said lower portion of said mixing chamber, the flow guide assembly including, a first conduit portion and a second conduit portion, the first and second conduit portions each being spaced from and extending radially about said shaft at positions spaced respectively above and below said scraper support arm, and defining a gap therebetween, a materials feed-pipe for conveying said materials to be milled into an upper portion of said first conduit portion, an impeller assembly coupled to said shaft at a position spaced below said scraper support arm for rotation therewith, said impeller assembly including at least one agitator blade having a pitch orientation selected whereby the rotation of said shaft and at least one agitator blade effects the downward flow of said materials from said first conduit portion and through said second conduit portion towards said mixing blade.

12. The grinding mill as claimed in claim 11, wherein said second conduit portion comprises an axially extending cylindrical wall coaxially aligned with said shaft and a plurality of baffle members extending from said cylindrical wall radially inwardly to a respective inner edge spaced a distance from said shaft.

13. The grinding mill as claimed in claim 12, wherein said chamber sidewall comprises substantially cylindrical sidewall, wherein each of cylindrical sidewall, said shaft and said conduit portions are substantially coaxially aligned.

14. The grinding mill as claimed in claim 13, wherein the second conduit portion includes at least one radially extending mounting arm for coupling said second conduit portion to said chamber sidewall.

15. The grinding mill as claimed in claim 14, wherein the impeller assembly comprises a pitch blade turbine impeller.

16. The grinding mill as claimed in claim 11, wherein the first conduit portion and the second conduit portion each comprises a cylindrical metal sleeve, each of the cylindrical sleeves being coaxially aligned and having substantially the same radial diameter.

17. The grinding mill as claimed in claim 16, wherein each said metal sleeve comprises a two-part metal sleeve construction having two mechanically connectable semi-cylindrical halves.

18. The grinding mill as claimed in claim 11, wherein the mixing blade comprises an axially elongated spiraling helical screw.

19. The grinding mill as claimed in claim 18, wherein the second conduit portion is mounted in said mixing chamber substantially adjacent to said helical screw.

20. The grinding mill as claimed in claim 11, wherein the grinding mill comprises a ball mill, and further comprises, an infeed port through said sidewall for introducing grinding balls into said mixing chamber, said infeed port being disposed vertically below said flow guide assembly.

* * * * *